United States Patent [19]

Biaggi

[11] 4,441,449

[45] Apr. 10, 1984

[54] PORT RAMP FOR ACCESS TO A ROLL-ON ROLL-OFF SHIP

[75] Inventor: Jacques Biaggi, Sevres, France

[73] Assignee: MacGregor International, S.A., Basel, Switzerland

[21] Appl. No.: 263,891

[22] Filed: May 15, 1981

Related U.S. Application Data

[63] Continuation of Ser. No. 888,472, Mar. 20, 1978, abandoned.

[30] Foreign Application Priority Data

Mar. 22, 1977 [FR] France ..... 77 08565

[51] Int. Cl.³ ..... B63B 27/14

[52] U.S. Cl. ..... 114/263; 114/230; 114/264; 14/28; 405/219

[58] Field of Search ..... 114/70, 231, 230, 263, 114/264; 405/219–221; 14/26, 27, 28, 71.1, 71.5

[56] References Cited

U.S. PATENT DOCUMENTS

| | | | |
|---|---|---|---|
| 981,991 | 1/1911 | Forssell | 14/28 |
| 1,700,153 | 1/1929 | Bradley | 114/263 |
| 2,939,291 | 6/1960 | Schurman et al. | 14/27 |
| 2,972,973 | 2/1961 | Thearle | 114/264 |
| 3,069,862 | 12/1962 | Ward | 114/70 |
| 4,066,030 | 1/1978 | Milone | 114/250 |
| 4,091,760 | 5/1978 | Lloyd | 114/264 |

FOREIGN PATENT DOCUMENTS

| | | | |
|---|---|---|---|
| 861079 | 1/1953 | Fed. Rep. of Germany . | |
| 1189577 | 3/1965 | Fed. Rep. of Germany | 14/27 |
| 2242136 | 3/1974 | Fed. Rep. of Germany | 14/27 |
| 21436 | 5/1919 | France . | |
| 2027542 | 11/1969 | France . | |
| 353257 | 7/1931 | United Kingdom . | |
| 1442983 | 7/1976 | United Kingdom . | |

*Primary Examiner*—Sherman D. Basinger
*Assistant Examiner*—Stephen P. Avila
*Attorney, Agent, or Firm*—Kenyon & Kenyon

[57] ABSTRACT

A port ramp for access to a ship, having a first end supported by a quay and a second end rigidly supported by a float, the float being anchored by blocks to the bottom by a connection of selectively adjustable length, the maximum buoyancy of the float being at least equal to the weight of the ramp added to the maximum load thereon, so that, when the float is submerged, the height of the ramp above the surface is independent of the load on the ramp.

5 Claims, 12 Drawing Figures

PORT RAMP FOR ACCESS TO A ROLL-ON ROLL-OFF SHIP

This is a continuation of application Ser. No. 888,472 filed Mar. 20, 1978 and now abandoned.

The present invention relates generally to a ramp for access to a roll-on-roll-off ship or like floating vessel, permitting the unloading and loading of the ship via said ramp, which provides a connection between a quay on a shore or a bank and the ship.

A number of types of such access ramps, which are installed in ports to permit the loading and unloading of ships, in particular roll-on roll-off ships, are already known. Such ramps are either supported by floats or rigidly anchored to the bottom of the port. They suffer from several drawbacks, for a ramp supported by a float sinks more or less into the water depending on the load which it is supporting. Moreover, it oscillates more or less according to the movement of the waves. On the other hand, a ramp bearing upon the bottom through pillars requires mechanical means of adjustment in height so as to follow the water level and the variations in draught. Such pillars, due to their spacing, make it necessary for the ramp to have a predetermined width precisely at its ship end, where it must be widest to facilitate vehicle maneuvering. In any case, they interfere with free movement and, above all, preclude any possibility of lateral displacement of the ramp into axial alignment with the ship, whatever the width of the ramp.

The invention has precisely for its purpose to provide a ramp for access to a ship or like floating vessel, in particular a roll-on roll-off ship, which is arranged above the water at a height that is independent of the useful load carried by the ramp and is nevertheless able to follow the draught variations of a ship in process of loading or unloading, and which is also capable of following the variations in water depth caused by the tides, so that the height of the ramp above the water always corresponds to the height of the deck of the ship whatever the variations of the useful load supported by the ramp the variations in draught and the state of the tides.

The invention also has for its purpose to provide such an access ramp, which can be moved to a position of rest and moored along a quay and retained at a constant distance therefrom.

The invention also has for its purpose such an access ramp, which is pivotable about its anchoring point on the quay, so as to be arranged in a particular position depending on the dimensions and the location of the particular ship concerned.

The invention therefore provides a port ramp for access to a ship or like floating vessel, in particular a roll-on roll-off ship, a first end of which is supported at a fixed point, e.g. on a shore or bank, by a quay, and a second end of which is supported by a float and intended to be placed in axial alignment with said ship to provide a connecting path between quay and ship permitting the loading and unloading of the ship through the ramp, characterized in that the float rigidly supports said second end of the ramp and is associated with means of anchoring to the bottom remaining constantly attached to the float, the connection between the anchoring means and the float being selectively adjustable in length, and the maximum buoyancy of the float being greater than or at least equal to that part of the weight of the ramp which is supported by the float plus a predetermined maximum useful load thereof, so that when the ramp is in working position the float occupies an over-submerged position in which it exerts on the said anchoring means a tractive force equal to the said predetermined maximum value of the useful load of the ramp, the height of the ramp above the water surface thus being independent of the supported useful load at any useful load value lower than the predetermined maximum value.

It is thus understood that an essential advantage of the ramp according to the invention is that its height above the water surface remains constant whatever the supported useful load so long as this useful load remains smaller than the tractive force exerted by the float on the moorings or anchoring blocks laid on the sea bed.

According to another characterizing feature of the invention, the float is ballastable and its maximum buoyancy is greater than the weight of the ramp and the moorings constituting the anchoring means, so that the float can assume a partially submerged position corresponding to a non-operating position of the ramp and also can lift said moorings.

Thus, the ramp according to the invention, when not in use, can follow the variations in water level caused by large tides.

The invention also relates to a method of use of the access ramp according to the invention, characterized in that it consists in lifting the moorings by deballasting the float, in moving the ramp about a vertical pivot axis at its one end to a desired angular position, in lowering the moorings until they are laid on the bottom, and in submerging the float to the desired depth by reducing its buoyancy by way of ballasting and in shortening the chains connecting the ramp to the moorings, so that the submerged float exerts on the moorings a tractive force at least equal to the predetermined maximum useful load of the ramp.

The invention will be better understood and other purposes, characterizing features, details and advantages will appear more clearly from the following explanatory description with reference to the appended diagrammatic drawings given solely by way of example illustrating several forms of embodiment of the invention and wherein.

Figure 7:
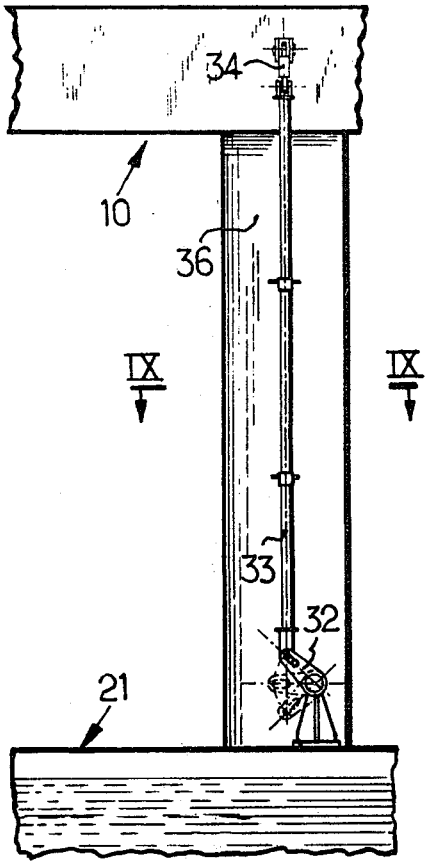
Figure 8:
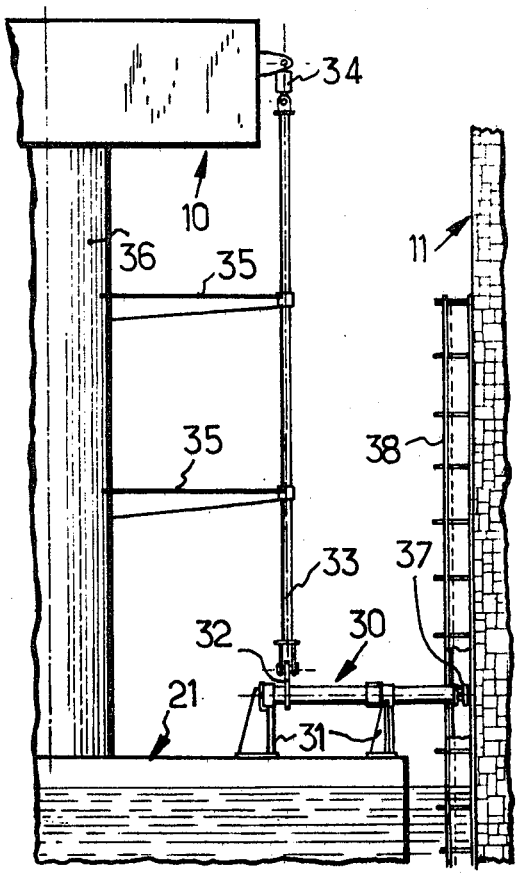
Figure 9:
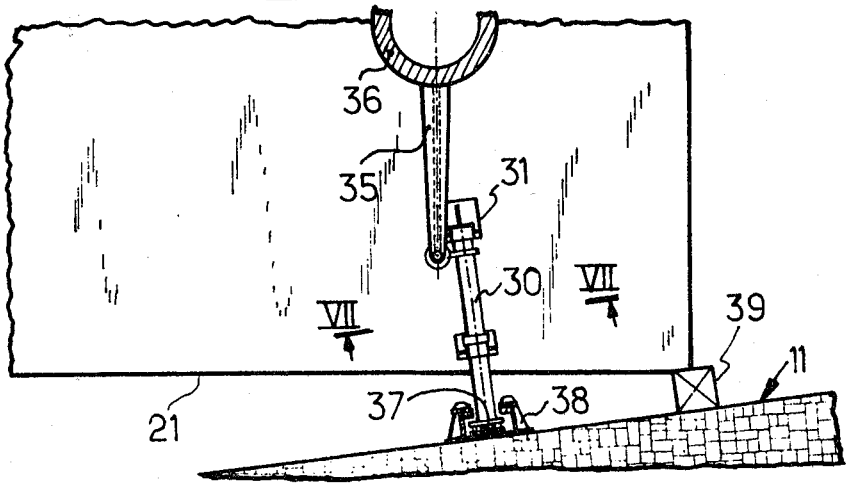
Figure 10:
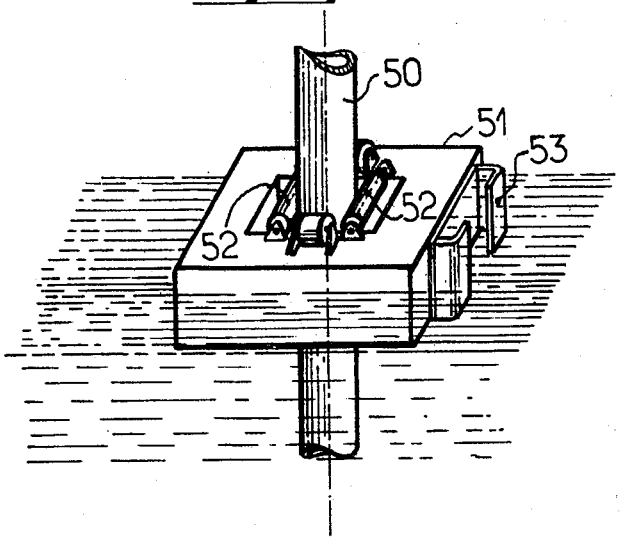
Figure 11:
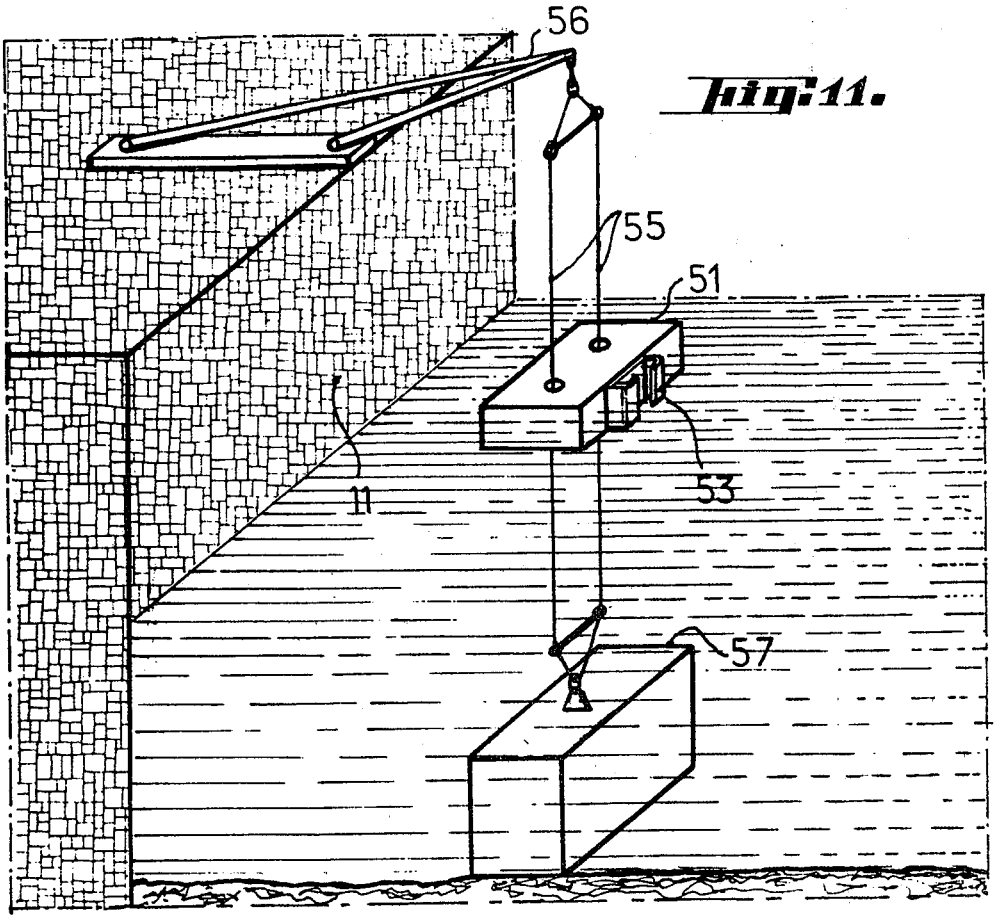
Figure 12:
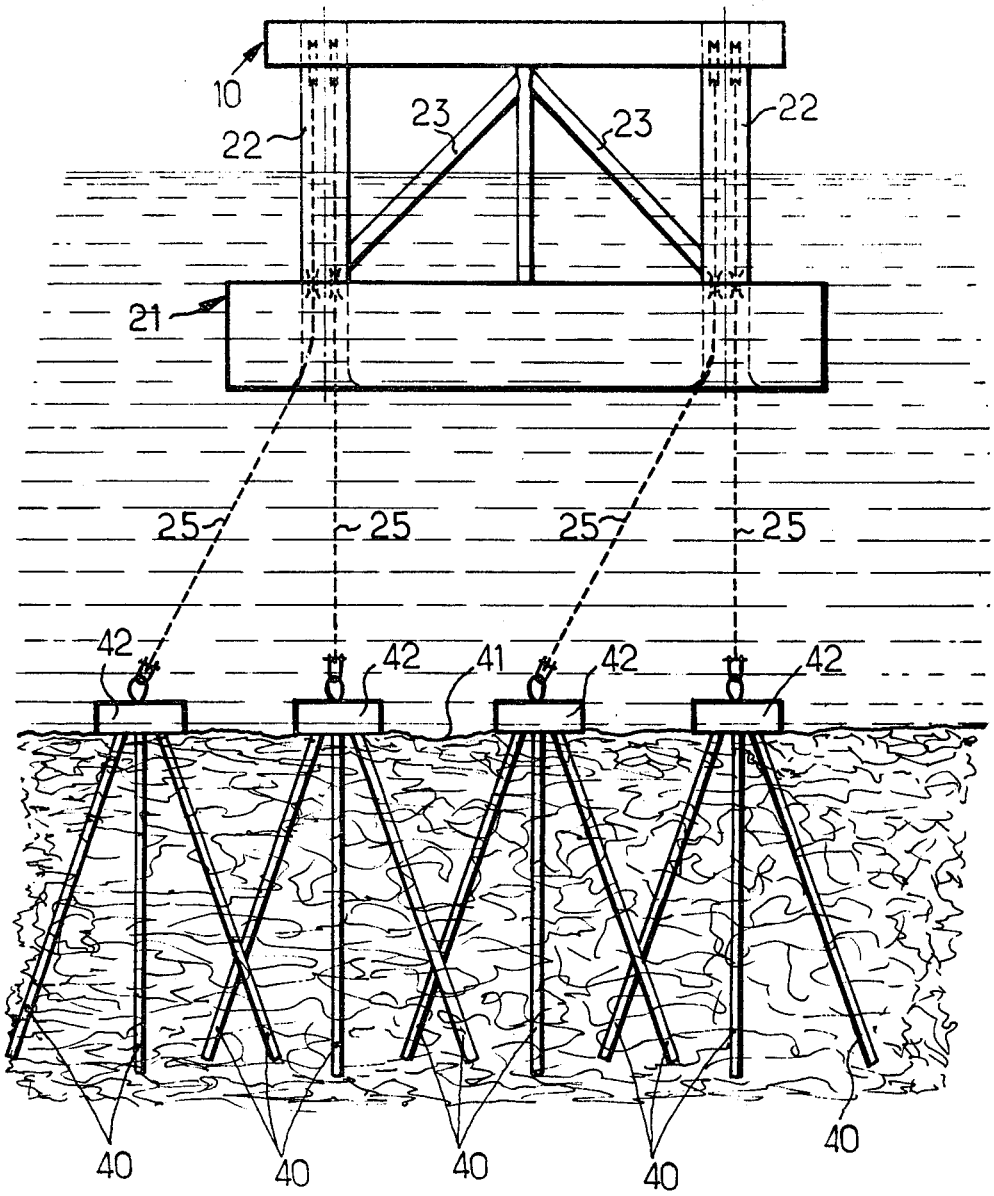

FIGS. 7, 8 and 9 diagrammatically illustrate the means of sliding vertical anchoring of the ramp in rest position on a quay, FIG. 7 being a front sectional view of such means upon the line VII—VII of FIG. 9, FIG. 8 being a side view and FIG. 9 being a top sectional view upon the line IX—IX of FIG. 7;

FIGS. 10 and 11 diagrammatically illustrate two modified forms of embodiment of the sliding vertical anchoring means; and FIG. 12 is a diagrammatic end view of a modified form of embodiment of a ramp according to the invention.

There is therefore illustrated in the drawings, more particularly in drawings 1 and 2, a preferred form of embodiment of an access ramp according to the invention intended for the loading and unloading of a ship, e.g. a roll-on roll-off ship, in a port.

The ramp 10 forms a kind of large-size bridge between a quay 11 and a ship 12 and comprises essentially a running path 13 for vehicles, the upper surface of which is provided with a non-skid coating, and at the ends of which are mounted flaps 14 and 15, respectively, each pivoted about a horizontal transverse axis, to ensure the continuity of the running surface 13 with the surface of the quay 11 and the corresponding surface of the ship 12.

The ramp 10 is provided with guard-rails or railings 16 along its longitudinal sides.

Figure 2:
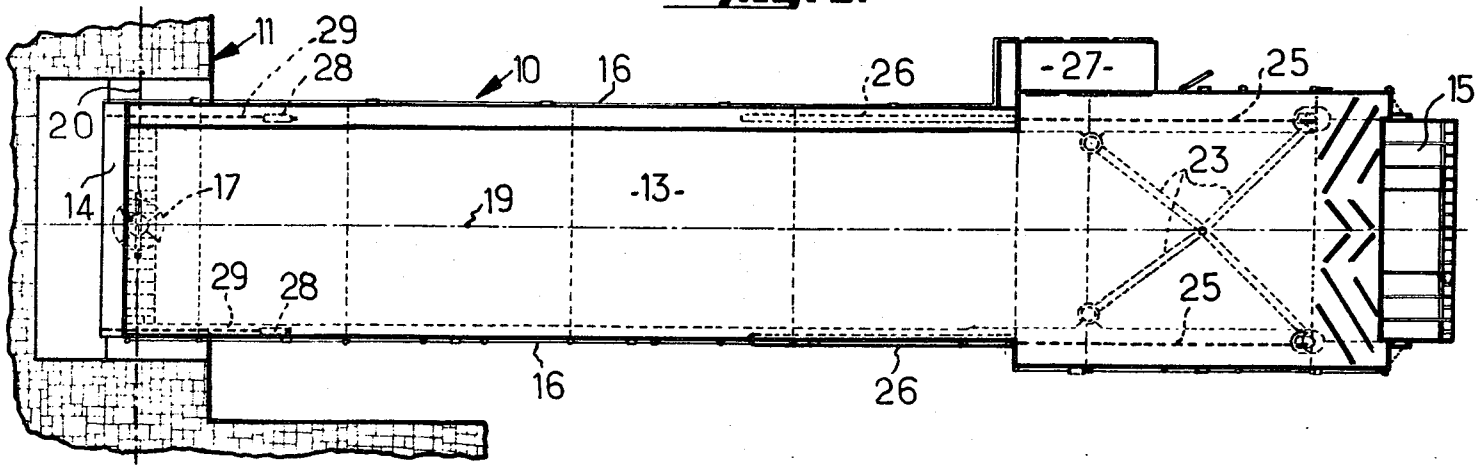
FIG. 2 is a top view of the ramp shown in FIG. 1.

According to the invention, a first end of the ramp 10 is supported by the quay 11, at an appropriate location of the latter, by means of a pivot 17 permitting the pivoting of the ramp 10 about a vertical axis 18 passing through the medial longitudinal axis 19 of the ramp, and about a transverse horizontal axis 20, as shown in FIG. 2.

At its other end or second end, the ramp 10 is supported by a float 21 to which it is rigidly connected by vertical poles or pillars 22 and oblique bars 23. This second end of the ramp is also associated with two moorings 24 carried by chains 25 passing through vertical passage-ways formed through the float 21 and within the vertical pillars 22 located under the front of the ramp, the said chains being connected to the piston rods of long-stroke hydraulic actuators 26 arranged longitudinally on either side of the ramp 10.

At its second end the ramp 10 is slightly greater in width and comprises a cabin 27 allowing the process of ship loading and unloading to be supervised and from which the ramp can be put into or out of operation as will be seen hereafter.

At the first end of the ramp are also provided two hydraulic actuators 28 arranged longitudinally on either side of the ramp 10 and the piston rods of which are connected to chains 29 whose ends are attached to the quay 11.

The float 21 is partially ballastable, i.e. its buoyancy may be caused to vary between a balance minimum value, compartments of the float then being filled with water, and a maximum value at which the compartments are practically completely filled with air under pressure. This maximum buoyancy of the float 21 is so selected as to be much greater than the total weight of the ramp 10 and the associated moorings 24.

Figure 1:
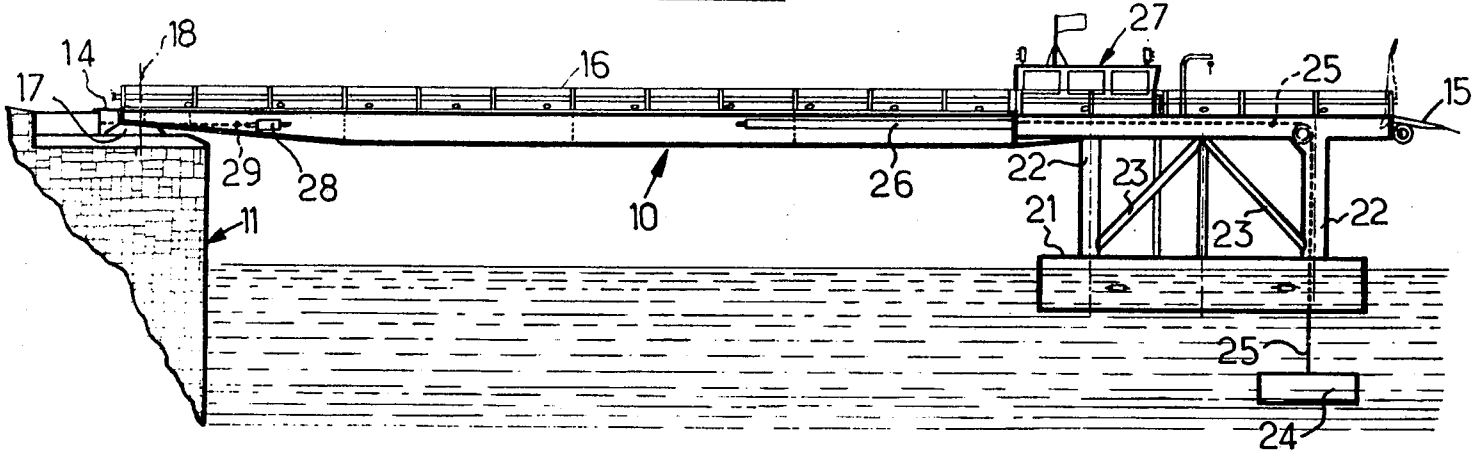
FIG. 1 is a side view of an access ramp according to the invention.
Figure 5:
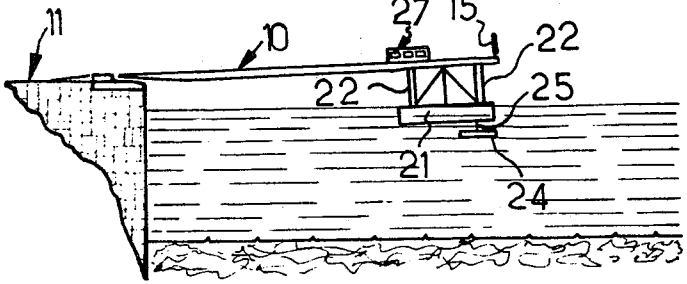
FIG. 5 is a diagrammatic view of the ramp according to the invention in rest position.

The ramp 10 according to the invention is used in the following manner:

In the position of rest, the float 21 is partially submerged as shown in FIGS. 1 and 5; the moorings 24 have been raised by means of the actuators 26 pulling the chains 25, possibly equipped with "stoppers", so that the ramp can float above the surface of the water through the medium of the float 21 and so follow the variations of the water level caused by the tides.

It will be noted that, in the case of small tides, the moorings 24 can remain laid on the sea bed, thus retaining the float 21 completely submerged.

Figure 6:
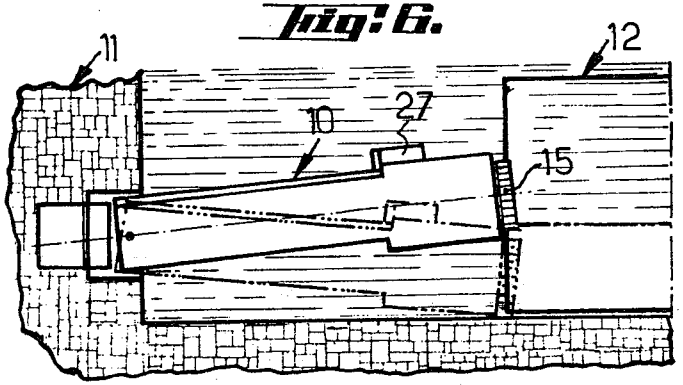
FIG. 6 shows the ramp in two different angular positions corresponding to ships of different sizes.

The ramp is put into operation in the following manner:

the ramp being in its position of rest or out of operation, with the moorings 24 previously raised and the float 21 partially submerged, it is possible to cause it to pivot about the vertical axis 18 of the pivot 17 by means of the actuators 28 and the chains 29, the actuator 28 located on the side where the ramp must rotate pulling the associated chain 29, whereas the other actuator 28 releases a corresponding length of its chain 29. The ramp 10 can thus be caused to pivot to any position, as shown in FIG. 6, according to the dimensions of the ship to be loaded or unloaded.

Figure 3:
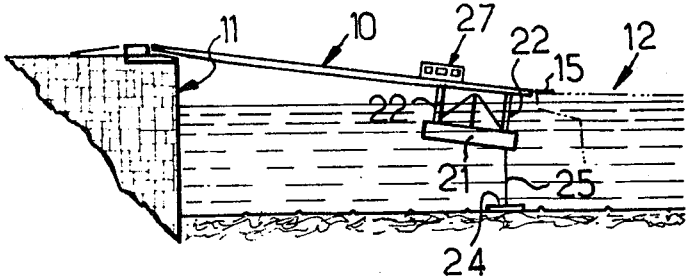

When the ramp 10 is thus set in the correct direction, the actuators 26 are operated to lower the moorings 24 until they rest on the sea bed, then the float 21 is ballasted to reduce its buoyancy to an appropriate value slightly higher than that part of the total weight of the ramp 10 carried by the float 21 and of its predetermined maximum useful load, and thereafter the float is submerged to an adequate depth, as shown for example in FIG. 3, by means of the actuators 26 which pull on the chains 25 of the moorings 24. Since the buoyancy of the float 21 is then inferior to that part of the total weight of the ramp 10 carried by the float 21 and the moorings 24, it is understood that the float 21 can be completely submerged. In this manner, the Archimedean thrust exerted by the water on the float 21 is constant whatever the depth of submersion of the float 21, which also means that the float 21 in the position shown in FIG. 3, or in FIG. 4, exerts a constant tractive force on the chains 25 connecting it to the moorings 24. During the loading or unloading of the ship 12 the useful load supported by the ramp 10 does not cause the latter to sink into the water to any degree so long as this useful load remains inferior to the predetermined maximum useful load.

Moreover, when a ship's own ramp is extended and caused to bear upon the ramp 10, it is possible to perform a partial unballasting so as to compensate for the weight or the fraction of weight of the ship's ramp. If the load is such that it does not vary during the loading and unloading operations, the buoyancy of the float 21 can be readily adjusted accordingly to make the tension in the chains slightly higher than the nominal useful load as previously.

If the load supported by the ramp 10 is smaller than this predetermined maximum load, the only effect of this load is that it causes a corresponding reduction in the tractive force exerted by the float 21 on the chains 25 of the moorings 24 without any variation of the height of the platform 10 above water level.

Figure 4:
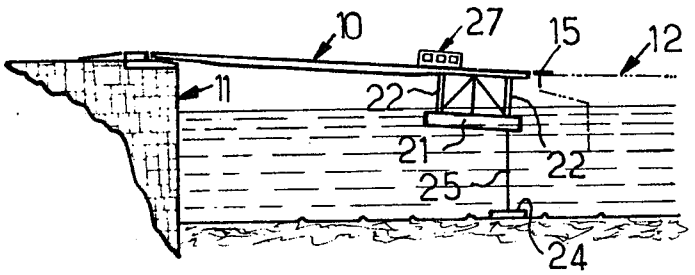
FIGS. 3 and 4 illustrate the variations of the inclination of the ramp according to the invention according to variations in draught at a constant water level.

Means not shown on the drawings are provided to cause the actuators 26 to be controlled by the difference in level between the second end of the ramp 10 and the side of a ship 12 in process of loading or unloading. Indeed, when the ship 12 is completely loaded, its draught is large, as shown for example in FIG. 3, and the length of the chains 25 extending between the float 21 and the moorings 24 is so adjusted by means of the actuators 26 that the flap 15 of the second end of the ramp 10 can reach approximately the level of the garage deck of the ship 12. As the unloading proceeds, the draught of the ship 12 diminishes, so that the ship rises little by little above the surface of the water, as represented in FIG. 4. The difference in level between the second end of the ramp 10 and the unloading end of the ship 12 is monitored by detector or sensor systems (e.g. inclinometers) which so control the actuators 26 as to increase the length of the chains 25 and thus automatically compensate for the decrease in draught of the ship 12. Between the beginning and the end of the unloading of the ship 12, the ramp 10 thus passes progressively from the position shown in FIG. 3 to the position represented in FIG. 4.

In the case of ships provided with their own ramp, the detector device is of course placed on the latter.

The invention also provides means (not shown) permitting the buoyancy of the float 21 to be automatically increased by unballasting the same in case the load supported by the ramp 10 should reach an emergency value close to the predetermined useful maximum load. It is understood that one only has to increase the buoyancy of the float 21 (the latter being completely submerged) to thus increase the value of the predetermined useful maximum load. These means may for example consist of a ballasting control system controlled by the value of the tension in the chains 25.

It will also be noted that the ramp 10, due to its construction, can be resiliently twisted to a small degree so as to be adapted to the temporary list of the ship 12 by applying various tensile forces to the chains 25 by means of the actuators 26. Such adjustment can be obtained automatically by means of a control servo-system controlled for example by an inclinometer mounted on the ship.

There are also provided means permitting the mooring of the second end of the ramp 10 to a quay when the ramp is in the inoperative position shown in FIGS. 1 and 5, e.g. in the case of exposed ports.

One of such means is represented in FIGS. 7, 8 and 9.

It is constituted essentially by a horizontal transverse bar 30 mounted on the horizontal upper plate of the float 21 by means of brackets 31 and rotatable about its longitudinal axis by means of a driver 32 rotating bodily with the bar 30 and the end of which is articulated on the end of the vertical piston rod 33 of a hydraulic actuator 34 mounted on one side of the second end of the platform 10. The rod 33 is slidingly guided in rings carried by horizontal arms 35 mounted on a post or pillar 36 connecting the ramp 10 to the float 21.

The free end of the bar 30 extending beyond the float 21 is provided with a head 37 of rectangular shape adapted to co-operate with a substantially vertical slide guide or guide-path 38 carried by a vertical wall of the quay 11 extending longitudinally beside the ramp 10 (the quay 11 can be replaced by a dolphin or a simple post).

In a first position, the head 37 can enter the slide guide or guide-path 38 by passing through a vertical longitudinal slot of appropriate dimension provided in the said slide guide, and, after the head 37 is given a quarter of a turn, it remains confined within the slide guide while at the same time being allowed to slide vertically therein. The rotation of the bar 30 over a quarter of a turn is obtained by means of the actuator 34. In order to impart some flexibility to the assembly, the bar 30 is axially movable in its bearings, its movement being resiliently stopped by rubber damping means not shown in the Figure but mounted to act as stops.

The vertical wall of the quay 11 is also provided with skids, fenders or like protective means 39 against which the extreme front edge of the float 21 abuts.

Thus, when the ramp 10 is in an inoperative position with the float 21 partially submerged and the anchoring blocks 24 raised, the ramp is brought nearer to the portion of the quay 11 which extends parallel therewith, so that the head 37 of the bar 30 can be engaged into the slide guide or guide-path 38. The head 37 is then caused to be retained within the slide guide 38 by being given a quarter of a turn by means of the actuator 34. The ramp 10 is thus retained at a constant distance from the quay while at the same time being able to move vertically according to the water level variations caused by the tides.

If the ramp is to be moored to a post 50 (FIG. 10), there is provided, according to a modified embodiment of the device of the invention, an auxiliary, small-size float 51 capable of rolling along the post 50 by means of four rollers 52. The float 51 is provided with a short slide guide 53 identical with the foregoing slide guide 38 and permitting easy mooring despite slight differences in level between the float 21 of the ramp and the auxiliary float 51.

Should it be impossible to drive a post or pile at the selected location, use could be made instead, according to the invention (FIG. 11), of two juxtaposed hawsers 55 suspended from the quay 11 by means of a gallows or the like 56 and weighted with a heavy block 57 not resting on the bottom. The weight of the block 57 is so calculated that its inertia is sufficient to preclude any considerable lateral displacement as a result of either traction or thrust exerted on the auxiliary float 51.

It will be noted, lastly that in port or harbour areas that are poorly developed or insufficiently developed to receive deep-draught ships, use can be made of a ramp according to the invention, which is constituted by several units such as those represented in the drawings and placed end to end, the first end of the first unit resting on the quay and being secured thereto in the manner already described, the second end of the last unit reaching a location in the immediate vicinity of the ship to be loaded or unloaded, and each intermediate unit resting by its first end on the second end of the preceding unit and supporting on its second end the first end of the following unit.

Also to be noted is the fact that a ramp according to the invention is readily transferable from one location to another by floating and/or towing.

It will also be mentioned, by way of non limitative example, that a ramp according to the invention can have a useful width of 9 meters, a length of 50 meters and that it can support a maximum load of about 65 tons.

Illustrated in FIG. 12 is a second form of embodiment of a ramp according to the invention, which is intended more particularly for use in ports where recurring siltings or chokings with sand are liable to bury the moorings or anchoring blocks used in the first form of embodiment illustrated in FIGS. 1 to 9.

In this case the means of anchoring to the bottom may consist not of displaceable moorings but of any system of permanent stationary anchoring of the chains 25 to the ramp. For example, such permanent stationary anchoring means may be constituted by poles or piles 40 fixedly driven into the sea bed 41 and substantially flush therewith, to which the chains 25 are attached permanently. For example, the piles 40 may be driven in by being struck above the surface of the water, and then severed in their submerged portion at a certain height, e.g. at about one meter above the bottom 41, to thereafter receive an underwater crown 42 of concrete in which the ends of the chains 25 may be embedded or to which they may be fastened by any appropriate means.

The ramp 10 may thus either be connected to only two concrete crowns 42 arranged right below the ramp or slightly outwardly of the latter, both corresponding chains 25 then extending obliquely from the concrete crowns 42 to the float 21, thus allowing the ramp to slightly pivot on the quay about the vertical pivot axis 18 of its first end by imparting different degrees of tension to the chains 25, or, in an alternative embodiment represented in FIG. 12, the ramp 10 may be associated through four chains 25 grouped in pairs with four permanent stationary anchoring means 42, respectively, transversely aligned on the sea bed 41, in groups of two. The distance between the stationary anchoring means 42 of each group may correspond to the distance over which it is desired to swivel the second end of the ramp 10, and the ramp may be maintained in any particular position by imparting various tensions to both chains 25 of a same group.

Another device may be used to free the mooring blocks from the ground in case they should be provided with a skirt of concrete or of steel to give their bottom the shape of a vault. To do this, it is sufficient to connect the vault portion thus formed to a centrifugal pump through the medium of a flexible pipe so as to exert a thrust several tens of times greater than the weight of the mooring block and thus easily free the block.

Of course the invention is by no means limited to the forms of embodiment described and illustrated which have been given by way of example only. In particular, it comprises all technical means equivalent to the means described, as well as their combinations, should the latter be carried out according to its gist and used within the scope of the following claims.

What is claimed is:

1. A method for using a port access ramp to a ship such as a roll-on roll-off ship, the method comprising:

supporting a first end of a ramp at a fixed level;

rigidly supporting the second end of the ramp from a float adjacent to a ship to provide a connecting path for loading and unloading the ship via said ramp;

anchoring the float by a line to anchoring blocks on the bottom;

ballasting or deballasting the float to achieve a buoyancy of the float at least equal to the sum of that part of the weight of the ramp which is carried by the float and a predetermined maximum useful load of the ramp, so that the said float exerts on the anchoring line a tension force at least equal to said maximum predetermined useful load of the ramp, whereby the height of the second end of said ramp above the surface of the water is independent of the load supported by the ramp up to said maximum useful load;

adjusting the length of the anchoring line with respect to variations of the draught of the ship and of the water level to allow the level of the second end of the ramp to conform to a deck level of the ship during the loading or unloading of the ship;

raising the anchoring blocks by deballasting the float to its maximum buoyancy; and pivoting the ramp about a vertical axis at the first end of the ramp to move the second end of the ramp from one location to another.

2. A method according to claim 1, further comprising:

deballasting the float to increase the buoyancy thereof when the tension in the anchoring line falls below a predetermined value.

3. A method according to claim 1, wherein variations of the draught of the ship are detected by differences in level between the second end of the ramp and the deck level of the ship.

4. A method according to claim 1 or 2, comprising:

maintaining the float submerged when the ramp is in its operative condition, and raising the float to a partial submersion when the ramp is in a inoperative condition.

5. A method according to claim 4, wherein, when the ramp is in its operative condition, the method comprises:

connecting the second end of the ramp to a quay by anchoring means permitting vertical displacement of the ramp according to the tide, and maintaining the second end of the ramp at a constant distance from the quay.

* * * * *